United States Patent [19]

Kukes et al.

[11] Patent Number: 4,564,441

[45] Date of Patent: Jan. 14, 1986

[54] HYDROFINING PROCESS FOR HYDROCARBON-CONTAINING FEED STREAMS

[75] Inventors: Simon G. Kukes; Edward L. Sughrue, II; Robert J. Hogan, all of Bartlesville, Okla.

[73] Assignee: Phillips Petroleum Company, Bartlesville, Okla.

[21] Appl. No.: 612,539

[22] Filed: May 21, 1984

Related U.S. Application Data

[63] Continuation-in-part of Ser. No. 520,780, Aug. 5, 1983, abandoned.

[51] Int. Cl.[4] ..... C10G 45/08; C10G 47/12; C10G 49/04

[52] U.S. Cl. ..... 208/108; 208/112; 208/216 R; 208/216 PP; 208/217; 208/251 H

[58] Field of Search ..... 208/108, 112, 213, 216 R, 208/217, 251 H

[56] References Cited

U.S. PATENT DOCUMENTS

| | | | |
|---|---|---|---|
| 3,331,769 | 7/1967 | Gatsis | 208/210 |
| 4,134,825 | 1/1979 | Bearden, Jr. et al. | 208/108 |
| 4,389,301 | 6/1983 | Dahlberg et al. | 208/59 |

*Primary Examiner*—D. E. Gantz
*Assistant Examiner*—O. Chaudhuri
*Attorney, Agent, or Firm*—French and Doescher

[57] ABSTRACT

At least one decomposable compound of a metal selected from the group consisting of copper, zinc and the metals of Group III-B, Group IV-B, Group VB, Group VIB, Group VIIB and Group VIII of the Periodic Table is mixed with a hydrocarbon-containing feed stream. The hydrocarbon-containing feed stream containing such decomposable compound is then contacted with a suitable refractory inorganic material to reduce the concentration of metals, sulfur and Ramsbottom carbon residue contained in the hydrocarbon-containing feed stream. The suitable refractory inorganic material may also be slurried with the hydrocarbon-containing feed stream.

60 Claims, No Drawings

HYDROFINING PROCESS FOR HYDROCARBON-CONTAINING FEED STREAMS

This application is a continuation-in-part of application Ser. No. 520,780 filed Aug. 5, 1983, now abandoned.

This invention relates to a hydrofining process for hydrocarbon-containing feed stream. In one aspect, this invention relates to a process for removing metals from a hydrocarbon-containing feed stream. In another aspect, this invention relates to a process for removing sulfur from a hydrocarbon-containing feed stream. In still another aspect, this invention relates to a process for removing potentially cokeable components from a hydrocarbon-containing feed stream.

It is well known that crude oil, crude oil fractions and extracts of heavy crude oils, as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and components which have a tendency to produce coke.

Processes in which the above described removals are accomplished are generally referred to as hydrofining processes (one or all of the above described removals may be accomplished in a hydrofining process depending on the components contained in the hydrocarbon-containing feed stream).

In accordance with the present invention, a hydrocarbon-containing feed stream, which also contains metals, sulfur and/or Ramsbottom carbon residue, is contacted with a suitable refractory inorganic material. At least one suitable decomposable compound of a metal selected from the group consisting of copper, zinc and the metals of Group III-B, Group IV-B, Group V-B, Group VI-B, Group VII-B and Group VIII of the Periodic Table (collectively referred to hereinafter as the "Decomposable Metal") is mixed with the hydrocarbon-containing feed stream prior to contacting the hydrocarbon-containing feed stream with the refractory material or is slurried with the refractory material in the hydrocarbon-containing feed stream. If the refractory material is not present in a slurry form, the hydrocarbon-containing feed stream, which also contains the Decomposable Metal, is contacted with the refractory material in the presence of hydrogen under suitable hydrofining conditions. Hydrogen and suitable hydrofining conditions are also present for the slurry process. After being contacted with the refractory material either after the addition of the Decomposable Metal or in a slurry process, the hydrocarbon-containing feed stream will contain a reduced concentration of metals, sulfur, and Ramsbottom carbon residue. Removal of these components from the hydrocarbon-containing feed stream in this manner provides an improved processability of the hydrocarbon-containing feed stream in processes such as catalytic cracking, hydrogenation or further hydrodesulfurization.

Other objects and advantages of the invention will be apparent from the foregoing brief description of the invention and the appended claims as well as the detailed description of the invention which follows.

Any suitable refractory inorganic material may be used in the hydrofining process to remove metals, sulfur and Ramsbottom carbon residue. Suitable refractory inorganic materials include metal oxides, silica, metal silicates, chemically combined metal oxides, metal phosphates and mixtures of any two or more thereof. Examples of suitable refractory inorganic materials include alumina, silica, silica-alumina, aluminosilicates (e.g. zeolites and clays), $P_2O_5$-alumina, $B_2O_3$-alumina magnesium oxide, calcium oxide, lanthanium oxide, cerium oxides ($Ce_2O_3$, $CeO_2$), thorium dioxide, titanium dioxide (titania), titania-alumina, zirconium dioxide, aluminum phosphate, magnesium phosphate, calcium phosphate, cerium phosphate, thorium phosphate, zirconium phosphate, zinc phosphate, zinc aluminate and zinc titanate. A refractory material containing at least 95 weight-% alumina, most preferably at least 97 weight-% alumina, is presently preferred for fixed bed and moving bed processes. Silica is a preferred refractory material for slurry or fluidized processes.

The refractory material can have any suitable surface area and pore volume. In general, the surface area will be in the range of about 10 to about 500 $m^2/g$, preferably about 20 to about 300 $m^2/g$, while the pore volume will be in the range of 0.1 to 3.0 cc/g, preferably about 0.3 to about 1.5 cc/g.

One of the novel features of the present invention is the discovery that promotion of the refractory inorganic material is not required when the Decomposable Metal is introduced into the hydrocarbon-containing feed stream. Thus, the refractory inorganic material used in accordance with the present invention will initially be substantially unpromoted and in particular will initially not contain any substantial concentration (about 1 weight-% or more) of a transition metal selected from copper, zinc and Group IIIB, IVB, VB, VIB, VIIB and VIII of the Periodic Table. When used in long runs a substantial concentration of the Decomposable Metal may build up on the refractory inorganic material. The discovery that promoters are not required for the refractory inorganic material is another factor which contributes to reducing the cost of a hydrofining process.

Any suitable hydrocarbon-containing feed stream may be hydrofined using the above described refractory material in accordance with the present invention. Suitable hydrocarbon-containing feed streams include petroleum products, coal, pyrolyzates, products from extraction and/or liquefaction of coal and lignite, products from tar sands, products from shale oil, supercritical extracts of heavy crudes, and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes, extracts of heavy crudes, and residuum and other materials which are generally regarded as too heavy to be distilled. These materials will generally contain the highest concentrations of metals, sulfur and Ramsbottom carbon residues.

It is believed that the concentration of any metal in the hydrocarbon-containing feed stream can be reduced using the above described refractory material in accordance with the present invention. However, the present invention is particularly applicable to the removal of vanadium, nickel and iron.

The sulfur which can be removed using the above described refractory material in accordance with the present invention will generally be contained in organic sulfur compounds. Examples of such organic sulfur compounds include sulfides, disulfides, mercaptans, thiophenes, benzylthiophenes, dibenzylthiophenes, and the like.

Any suitable decomposable compound can be introduced into the hydrocarbon-containing feed stream. Examples of suitable compounds are aliphatic, cycloaliphatic and aromatic carboxylates having 1–20 carbon atoms, diketones, carbonyls, cyclopentadienyl complexes, mercaptides, xanthates, carbamates, dithiocarbamates and dithiophosphates. Any suitable Decomposable Metal can be used. Preferred Decomposable Metals are molybdenum, chromium, tungsten, manganese, nickel and cobalt. Molybdenum is a particularly preferred Decomposable Metal which may be introduced as a carbonyl, acetate, acetylacetonate, octoate (2-ethyl hexanoate), dithiocarbamate, naphthenate or dithiophosphate. Molybdenum hexacarbonyl, molybdenum dithiocarbamate and molybdenum dithiophosphate are particularly preferred additives.

Any suitable concentration of the Decomposable Metal may be added to the hydrocarbon-containing feed stream. In general, a sufficient quantity of the decomposable compound will be added to the hydrocarbon-containing feed steam to result in a concentration of the Decomposable Metal in the range of about 1 to about 600 ppm and more preferably in the range of about 2 to about 100 ppm.

High concentrations, such as above about 600 ppm, should be avoided to prevent plugging of the reactor in fixed bed operation. It is noted that one of the particular advantages of the present invention is the very small concentrations of the Decomposable Metal which result in a significant improvement. This substantially improves the economic viability of the process which is again a primary objective of the present invention.

After the Decomposable Metal has been added to the hydrocarbon-containing feed stream for a period of time, only periodic introduction of the Decomposable Metal may be required to maintain the efficiency of the process.

The Decomposable Metal may be combined with the hydrocarbon-containing feed stream in any suitable manner. The Decomposable Metal may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the Decomposable Metal into the hydrocarbon-containing feed stream is sufficient. No special mixing equipment or mixing period are required.

The pressure and temperature at which the Decomposable Metal is introduced into the hydrocarbon-containing feed stream is not thought to be critical. However, a temperature below 450° C. is recommended.

The hydrofining process can be carried out by means of any apparatus whereby there is achieved a contact of the refractory material with the hydrocarbon-containing feed stream and hydrogen under suitable hydrofining conditions. The hydrofining process is in no way limited to the use of a particular apparatus. The hydrofining process can be carried out using a fixed bed or moving bed or using fluidized operation which is also referred to as slurry or hydrovisbreaking operation. Presently preferred is a fixed bed.

Any suitable reaction time between the refractory material and the hydrocarbon-containing feed stream may be utilized. In general, the reaction time will range from about 0.1 hours to about 10 hours. Preferably, the reaction time will range from about 0.4 to about 4 hours. Thus, the flow rate of the hydrocarbon-containing feed stream should be such that the time required for the passage of the mixture through the reactor (residence time) will preferably be in the range of about 0.4 to about 4 hours. In fixed bed operations, this generally requires a liquid hourly space velocity (LHSV) in the range of about 0.10 to about 10 cc of oil per cc of refractory material per hour, preferably from about 0.25 to about 2.5 cc/cc/hr.

In continuous slurry operations, oil and refractory material generally are premixed at a weight ratio in the range of from about 100:1 to about 10:1. The mixture is then pumped through the reactor at a rate so as to give the above-cited residence times.

The hydrofining process can be carried out at any suitable temperature. The temperature will generally be in the range of about 150° to about 550° C. and will preferably be in the range of about 350° to about 450° C. Higher temperatures do improve the removal of metals but temperatures should not be utilized which will have adverse effects, such as coking, on the hydrocarbon-containing feed stream and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the refractory material is utilized until a satisfactory level of metals removal fails to be achieved which is believed to result from the loading of the refractory material with the metals being removed. It is possible to remove the metals from the refractory material by certain leaching procedures but these procedures are expensive and it is generally contemplated that, once the removal of metals falls below a desired level, the used refractory material will simply be replaced by a fresh refractory material.

In a slurry process, the problem of the refractory material losing activity may be avoided if only a part of the refractory material is recycled and new refractory material is added.

The time in which the refractory material will maintain its activity for removal of metals will depend upon the metals concentration in the hydrocarbon-containing feed streams being treated. It is believed that the refractory material may be used for a period of time long enough to accumulate 10–200 weight percent of metals, mostly Ni, V, and Fe, based on the weight of the refractory material from oils.

The following examples are presented in further illustration of the invention.

EXAMPLE I

In this example pertinent effects of hydrotreating a heavy oil in a fixed bed process, with and without added decomposable molybdenum compounds, are described. A hydrocarbon feed comprising 26 weight-% of toluene and 74 weight-% of a Venezuelan Monagas pipeline oil was pumped by means of a LAPP Model 211 (General Electric Company) pump to a metallic mixing T-pipe, where it was mixed with a controlled amount of hydrogen gas. The oil/hydrogen mixture was pumped downward through a stainless steel trickle bed reactor (28.5 inches long, 0.75 inches inner diameter), fitted inside with a 0.25 inches O.D. axial thermocouple well. The reactor was filled with a top layer (3.5 inches below the oil/$H_2$ feed inlet) of 50 cc of low surface area (less than 1 $m^2$/gram) $\alpha$-alumina (Alundum, marketed by Norton Chemical Process Products, Akron, Ohio), a middle layer of 50 cc of high surface area alumina (Trilobe® SN-5548 alumina catalyst containing about 2.6 weight-% $SiO_2$; having a surface area, as determined by BET method with $N_2$, of 144 $m^2$/g; having a pore volume, as determined by mercury porosimetry at 50 K psi Hg, of 0.92 cc/g; and having an average micropore diameter, as calculated from pore volume and surface area, of 170 Å; marketed by American Cyanamid Co., Stanford Conn.), and a bottom layer of 50 cc of $\alpha$-alumina. The Trilobe® alumina was heated overnight under hydrogen before it was used.

The reactor tube was heated by means of a Thermcraft (Winston-Salem, N.C.) Model 211 3-zone furnace. The reactor temperature was usually measured in four locations along the reactor bed by a traveling thermocouple that was moved within the axial thermocouple well. The liquid product was collected in a receiver vessel, filtered through a glass frit and analyzed. Vanadium and nickel content in oil was determined by plasma emission analysis; sulfur content was measured by x-ray fluorescence spectrometry. Exiting hydrogen gas was vented.

The decomposable molybdenum compound, when used, was added to the toluene-oil feed. This mixture was subsequently stirred for about 2 hours at about 40° C.

Results of four control runs, six invention runs with dissolved Mo(IV) octoate, $MoO(C_7H_{15}CO_2)_2$, (containing about 8 wt-% Mo; marketed by Shepherd Chemical Company, Cincinnati, Ohio) in the feed and four invention runs with Mo(V) naphthenate, $Mo(C_{10}H_2CO_2)_5$, (marketed by ICN Pharmaceuticals, Inc., Plain View, N.Y.) are shown in Table I. In all runs, the reactor temperature was 400° C. and the hydrogen pressure was about 1,000 psig.

TABLE I

| Run | LHSV (cc/cc/hr) | Run Time (hours) | Demetalliz. Agent | Feed: Added Mo (ppm) | Feed: Ni (ppm) | Feed: V (ppm) | Feed: Ni + V (ppm) | Feed: S (wt %) |
|---|---|---|---|---|---|---|---|---|
| 1 (Control) | 1.32 | 6 | None | 0 | 75 | 295 | 370 | 2.12 |
| | 1.39 | 12 | None | 0 | 75 | 295 | 370 | 2.12 |
| | 1.40 | 18 | None | 0 | 75 | 295 | 370 | 2.12 |
| | 1.39 | 24 | None | 0 | 75 | 295 | 370 | 2.12 |
| 2 (Invention) | 1.41 | 7.5 | Mo(IV) Octoate | 515 | 69 | 275 | 344 | 2.20 |
| | 1.39 | 15 | Mo(IV) Octoate | 515 | 69 | 275 | 344 | 2.20 |
| | 1.39[1] | 22.5 | Mo(IV) Octoate | 515 | 69 | 275 | 344 | 2.20 |
| | 1.41[1] | 27.5 | Mo(IV) Octoate | 515 | 69 | 275 | 344 | 2.20 |
| | 1.44 | 31 | Mo(IV) Octoate | 515 | 69 | 275 | 344 | 2.20 |
| | 1.37 | 34 | Mo(IV) Octoate | 515 | 69 | 275 | 344 | 2.20 |
| 3 (Invention) | 1.37 | 7 | Mo(V) Naphth. | 583 | 75 | 305 | 380 | 2.24 |
| | 1.38 | 13 | Mo(V) Naphth. | 583 | 75 | 305 | 380 | 2.24 |
| | 1.45[1] | 17 | Mo(V) Naphth. | 583 | 75 | 305 | 380 | 2.24 |
| | 1.27[1] | 21 | Mo(V) Naphth. | 583 | 75 | 305 | 380 | 2.24 |

| Run | Product: Ni (ppm) | Product: V (ppm) | Product: Ni + V (ppm) | Product: S (wt %) | % Removal of (Ni + V) | % Removal of S |
|---|---|---|---|---|---|---|
| 1 (Control) | 64 | 232 | 296 | 1.88 | 20 | 11 |
| | 66 | 228 | 294 | 1.68 | 21 | 21 |
| | 66 | 230 | 296 | 1.68 | 20 | 21 |
| | 71 | 247 | 318 | 1.70 | 14 | 20 |
| 2 (Invention) | 49 | 175 | 224 | 1.68 | 35 | 24 |
| | 45 | 159 | 204 | 1.48 | 41 | 33 |
| | 42 | 155 | 187 | 1.50 | 46 | 32 |
| | 40 | 145 | 185 | 1.51 | 46 | 31 |
| | 36 | 128 | 164 | 1.43 | 52 | 35 |
| | 41 | 145 | 186 | 1.52 | 46 | 31 |
| 3 (Invention) | 50 | 189 | 239 | 1.60 | 37 | 29 |
| | 52 | 198 | 250 | 1.57 | 34 | 30 |
| | 48 | 174 | 222 | 1.46 | 42 | 35 |
| | 47 | 164 | 211 | 1.48 | 44 | 31 |

[1]occasional plugging was observed

Data in Table I show distinct demetallization and desulfurization advantages of the presence of molybdenum compounds in the feed (Runs 2, 3) versus control runs without molybdenum in the feed (Run 1).

Based on the performance of molybdenum as demonstrated in this example and the following examples, it is believed that the other Decomposable Metals listed in the specification would also have some beneficial effect. These other metals are generally effective as hydrogenation components and it is believed that these metals would tend to enhance the opening of molecules containing metals and sulfur which would aid the removal of metals and sulfur.

EXAMPLE II

This example illustrates the effects of a small amount (13 ppm) of molybdenum in another heavy oil feed, (a topped, 650° F.+ Arabian heavy crude) in long-term hydrodemetallization and hydrodesulfurization runs. These runs were carried out essentially in accordance with the procedure described in Example I, with the following exceptions: (a) the demetallizing agent was $Mo(CO)_6$, marketed by Aldrich Chemical Company, Milwaukee, Wis.; (b) the oil pump was a Whitey Model LP 10 reciprocating pump with diaphragm-sealed head, marketed by Whitey Corp., Highlands Heights; Ohio; (c) hydrogen gas was introduced into the reactor through a tube that concentrically surrounded the oil induction tube; (d) the temperature was measured in the catalyst bed at three different locations by means of three separate thermocouples embedded in an axial thermocouple well (0.25 inch outer diameter); and (e) the decomposable molybdenum compound, when used, was mixed in the feed by placing a desired amount in a steel drum of 55 gallons capacity, filling the drum with the feed oil having a temperature of about 160° F. and circulating oil plus additive for about 2 days with a circulatory pump for complete mixing. In all runs the reactor temperature was about 407° C. (765° F.); the $H_2$ pressure was 2250 psig in runs 4 in 5, and 2000 psig in run 6; the $H_2$ feed rate was 4800 standard cubic feet per barrel (SCFB); the refractory material was Trilobe® alumina marketed by American Cyanamid Company. Pertinent experimental data are summarized in Table II.

Data in Table II clearly show the demetallization and desulfurization advantages of small amounts of Mo (as molybdenum hexacarbonyl) in the feed. As demonstrated by run 6, excessive amounts of Mo (about 2000 ppm) were not beneficial because of fixed bed plugging after about 1 day.

The amount of Ramsbottom carbon residue (not listed in Table II) was generally lower in the hydrotreated product of invention run 5 (8.4–9.3 weight-% Ramsbotton C) than in the product of control run 4 (9.1–10.3 weight-% Ramsbottom C). The untreated feed had a Ramsbottom carbon content of about 11.6 weight-%.

TABLE II

| | | | | Feed | | | | |
|---|---|---|---|---|---|---|---|---|
| Run | Days on Stream | LHSV (cc/cc/hr) | Demetalliz. Agent | Added Mo (ppm) | Ni (ppm) | V (ppm) | Ni + V (ppm) | S (wt %) |
| 4 (Control) | 3 | 1.00 | None | — | 34 | 99 | 133 | 3.93 |
| | 5 | 1.01 | None | — | 34 | 99 | 133 | 3.93 |
| | 10 | 0.98 | None | — | 34 | 99 | 133 | 3.93 |
| | 11 | 0.98 | None | — | 34 | 99 | 133 | 3.93 |
| | 13 | 0.98 | None | — | 34 | 99 | 133 | 3.93 |
| | 16 | 0.96 | None | — | 34 | 99 | 133 | 3.93 |
| | 17 | 0.98 | None | — | 34 | 99 | 133 | 3.93 |
| | 18 | 0.96 | None | — | 34 | 99 | 133 | 3.93 |
| | 20 | 0.98 | None | — | 34 | 99 | 133 | 3.93 |
| 5 (Invention) | 3 | 0.90 | $Mo(CO)_6$ | 13 | 20 | 100 | 126 | 3.98 |
| | 5 | 0.94 | $Mo(CO)_6$ | 13 | 26 | 100 | 126 | 3.98 |
| | 6 | 1.02 | $Mo(CO)_6$ | 13 | 26 | 100 | 126 | 3.98 |
| | 7 | 1.05 | $Mo(CO)_6$ | 13 | 26 | 100 | 126 | 3.98 |
| | 9 | 0.96 | $Mo(CO)_6$ | 13 | 26 | 100 | 126 | 3.98 |
| | 10 | 0.96 | $Mo(CO)_6$ | 13 | 26 | 100 | 126 | 3.98 |
| | 14 | 0.96 | $Mo(CO)_6$ | 13 | 26 | 100 | 126 | 3.98 |
| | 15 | 1.00 | $Mo(CO)_6$ | 13 | 26 | 100 | 126 | 3.98 |
| | 16 | 1.02 | $Mo(CO)_6$ | 13 | 26 | 100 | 126 | 3.98 |
| | 17 | 1.02 | $Mo(CO)_6$ | 13 | 26 | 100 | 126 | 3.98 |
| 6 (Control) | 1 | 1.16 | $Mo(CO)_6$ | | | 2000 | | |

| | Product | | | | % Removal | |
|---|---|---|---|---|---|---|
| Run | Ni (ppm) | V (ppm) | Ni + V (ppm) | S (wt %) | of (Ni + V) | of S |
| 4 (Control) | 22 | 56 | 78 | 3.03 | 43 | 23 |
| | 20 | 53 | 73 | 3.17 | 45 | 19 |
| | 18 | 36 | 54 | 3.04 | 59 | 23 |
| | 18 | 35 | 54 | 3.13 | 59 | 20 |
| | 18 | 33 | 51 | 3.10 | 62 | 21 |
| | 18 | 30 | 48 | 3.01 | 64 | 23 |
| | 19 | 29 | 47 | 3.01 | 65 | 22 |
| | 25 | 40 | 65 | 3.00 | 51 | 24 |
| | 16 | 26 | 42 | 3.02 | 68 | 23 |
| 5 (Invention) | 19 | 31 | 50 | — | 60 | — |
| | 16 | 30 | 46 | — | 63 | — |
| | 16 | 32 | 48 | 2.94 | 62 | 26 |
| | 15 | 30 | 45 | — | 64 | — |
| | 14 | 26 | 40 | 2.93 | 68 | 26 |
| | 12 | 20 | 32 | — | 75 | — |
| | 12 | 19 | 31 | — | 75 | — |
| | 13 | 19 | 32 | 2.67 | 75 | 33 |
| | 11 | 16 | 27 | — | 79 | — |
| | 13 | 20 | 33 | — | 74 | — |

TABLE II-continued

| | |
|---|---|
| 6 (Control) | Reactor plugged after 30 hours; test was terminated |

EXAMPLE III

This example illustrates the effects of small amounts of $Mo(CO)_6$ in the feed on the hydrometallization and hydrodesulfurization of a topped Arabian heavy crude, carried out essentially in accordance with the procedure described in Example II, with the exception that Katalco alumina was used. Katalco alumina had a surface area of 181 $m^2/g$, a total pore volume of 1.05 cc/g (both determined by mercury porosimetry) and an average pore diameter of about 231 A (calculated); and is marketed by Katalco Corp.; Chicago, Ill. The refractory material was heated overnight under hydrogen. Process conditions were the same as those cited in Example II. Results are summarized in Table III.

The amount of Ramsbottom carbon residue (not listed in Table III) was lower in the hydrotreated product of invention run 8 (9.6–10.0 weight-% Ramsbottom C) than in the product of control run 7 (10.2–10.6 weight-% Ramsbottom C). The untreated feed had a Ramsbottom carbon content of 11.5–11.8 weight-%.

EXAMPLE IV

In this example an undiluted, non-desalted Monagas heavy crude was hydrotreated over Katalco alumina, essentially in accordance with the procedure described in Example III. Mechanical problems, especially during invention run 12, caused erratic feed rates and demetallization results. Because of this, data of these runs summarized in Table IV do not show, during the period of 2–7 days, as clearly as in previous examples, the benefit of Mo in the feed during hydrotreatment employing Katalco alumina in the refractory material.

TABLE III

| | | | | Feed | | | | |
|---|---|---|---|---|---|---|---|---|
| Run | LHSV (cc/cc/hr) | Days on Stream | Demetalliz. Agent | Added Mo (ppm) | Ni (ppm) | V (ppm) | Ni + V (ppm) | S (wt %) |
| 7 (Control) | 1.04 | 5 | None | 0 | 32 | 105 | 137 | — |
| | 0.99 | 6 | None | 0 | 32 | 105 | 137 | — |
| | 1.00 | 7 | None | 0 | 32 | 105 | 137 | — |
| | 1.01 | 8 | None | 0 | 32 | 105 | 137 | — |
| | — | 9 | None | 0 | 32 | 105 | 137 | — |
| | — | 10 | None | 0 | 32 | 105 | 137 | — |
| | 0.99 | 11 | None | 0 | 32 | 105 | 137 | — |
| | 1.01 | 12 | None | 0 | 32 | 105 | 137 | — |
| | | 13 | None | 0 | 32 | 105 | 137 | — |
| | | 14 | None | 0 | 32 | 105 | 137 | — |
| 8 (Invention) | 1.09 | 5 | $Mo(CO)_6$ | 11 | 25 | 101 | 126 | 3.98 |
| | 1.09 | 6 | $Mo(CO)_6$ | 11 | 25 | 101 | 126 | 3.98 |
| | 1.14 | 7 | $Mo(CO)_6$ | 11 | 25 | 101 | 126 | 3.98 |
| | 1.07 | 8 | $Mo(CO)_6$ | 11 | 25 | 101 | 126 | 3.98 |
| | 1.07 | 9 | $Mo(CO)_6$ | 11 | 25 | 101 | 126 | 3.98 |
| | 1.02 | 10 | $Mo(CO)_6$ | 11 | 25 | 101 | 126 | 3.98 |
| | 0.80 | 11 | $Mo(CO)_6$ | 11 | 25 | 101 | 126 | 3.98 |
| | 0.95 | 12 | $Mo(CO)_6$ | 11 | 25 | 101 | 126 | 3.98 |
| | 0.94 | 14 | $Mo(CO)_6$ | 11 | 25 | 101 | 126 | 3.98 |

| | Product | | | | % Removal | |
|---|---|---|---|---|---|---|
| Run | Ni (ppm) | V (ppm) | Ni + V (ppm) | S (wt %) | of (Ni + V) | of S |
| 7 (Control) | 26 | 74 | 100 | 3.20 | 27 | — |
| | 25 | 59 | 84 | 3.71 | 39 | — |
| | 26 | 59 | 85 | 3.66 | 38 | — |
| | 25 | 56 | 81 | 3.68 | 41 | — |
| | 24 | 61 | 85 | — | 38 | — |
| | 24 | 58 | 82 | — | 40 | — |
| | 23 | 57 | 80 | — | 42 | — |
| | 24 | 57 | 81 | — | 41 | — |
| | 23 | 56 | 79 | — | 42 | — |
| | 24 | 49 | 73 | — | 47 | — |
| 8 (Invention) | 20 | 57 | 77 | — | 39 | — |
| | 21 | 52 | 73 | 3.32 | 42 | 17 |
| | 16 | 38 | 54 | — | 57 | — |
| | 16 | 41 | 57 | — | 55 | — |
| | 18 | 41 | 59 | 3.30 | 53 | 17 |
| | 16 | 32 | 48 | — | 62 | — |
| | 14 | 25 | 39 | — | 69 | — |
| | 16 | 27 | 43 | 3.17 | 66 | 20 |
| | 15 | 22 | 37 | — | 71 | — |

Data in Table III clearly show that small amounts of Mo (as $Mo(CO)_6$) in an Arabian heavy crude have a definite beneficial effect on the removal of nickel and vanadium, especially after about 7 days.

TABLE IV

| Run | Day on Stream | LHSV (cc/cc/hr) | Demetalliz. Agent | Feed Added Mo (ppm) | Feed Ni (ppm) | Feed V (ppm) | Feed Ni + V (ppm) | Product Ni (ppm) | Product V (ppm) | Product Ni + V (ppm) | Removal of (Ni + V) |
|---|---|---|---|---|---|---|---|---|---|---|---|
| 9 (Control) | 2 | 1.00 | None | 0 | 89 | 328 | 417 | 67 | 217 | 284 | 32 |
| | 5 | 1.04 | None | 0 | 89 | 328 | 417 | 71 | 221 | 292 | 30 |
| | 6 | 0.93 | None | 0 | 89 | 328 | 417 | 66 | 192 | 258 | 38 |
| | 7 | 0.98 | None | 0 | 89 | 328 | 417 | 67 | 193 | 260 | 38 |
| 10 (Control) | 2.5 | 0.94 | None | 0 | 105 | 358 | 463 | 51 | 159 | 210 | 55 |
| | 3.5 | 0.94 | None | 0 | 105 | 358 | 463 | 57 | 156 | 213 | 54 |
| | 4.5 | 0.94 | None | 0 | 105 | 358 | 463 | 57 | 111 | 168 | 64 |
| | 5.5 | 1.00 | None | 0 | 105 | 358 | 463 | 59 | 124 | 183 | 60 |
| | 6.5 | 0.93 | None | 0 | 105 | 358 | 463 | 58 | 119 | 177 | 62 |
| | 7.5 | 0.95 | None | 0 | 105 | 358 | 463 | 44 | 123 | 167 | 64 |
| | 8.5 | 0.89 | None | 0 | 105 | 358 | 463 | 55 | 114 | 169 | 63 |
| | 9.5 | 1.06 | None | 0 | 105 | 358 | 463 | 47 | 130 | 177 | 62 |
| | 11.5 | 0.97 | None | 0 | 105 | 358 | 463 | 59 | 114 | 173 | 63 |
| | 12.5 | 0.98 | None | 0 | 105 | 358 | 463 | 56 | 118 | 174 | 62 |
| | 13.5 | 1.06 | None | 0 | 105 | 358 | 463 | 60 | 133 | 193 | 58 |
| | 15.5 | 0.98 | None | 0 | 105 | 358 | 463 | 53 | 114 | 167 | 64 |
| 11 (Control) | 2 | 0.97 | None | 0 | 87 | 336 | 423 | 47 | 189 | 236 | 44 |
| | 4 | 0.89 | None | 0 | 87 | 336 | 423 | 42 | 156 | 198 | 53 |
| | 8 | 0.91 | None | 0 | 87 | 336 | 423 | 50 | 137 | 187 | 56 |
| | 9 | 0.94 | None | 0 | 87 | 336 | 423 | 46 | 137 | 183 | 57 |
| 12 (Invention) | 2 | 1.02 | $Mo(CO)_6$ | 60 | 87 | 336 | 423 | 63 | 227 | 290 | 31 |
| | 6 | 1.04 | $Mo(CO)_6$ | 60 | 87 | 336 | 423 | 60 | 155 | 215 | 49 |
| | 7 | 1.00 | $Mo(CO)_6$ | 60 | 87 | 336 | 423 | 51 | 86 | 137 | 68 |
| | 10 | 0.94 | $Mo(CO)_6$ | 60 | 87 | 336 | 423 | 51 | 99 | 150 | 65 |
| | 14 | 0.90 | $Mo(CO)_6$ | 60 | 87 | 336 | 423 | 54 | 108 | 162 | 62 |
| | 17 | 1.02 | $Mo(CO)_6$ | 60 | 87 | 336 | 423 | 52 | 116 | 168 | 60 |

EXAMPLE V

This example illustrates the effects of molybdenum hexacarbonyl dissolved in an undiluted Monagas heavy crude (containing about 2.6 weight percent sulfur and about 11.3 weight percent Ramsbottom carbon) on the hydrometallization of said crude in a fixed catalyst bed containing solid refractory materials other than alumina. Runs 13–17 were carried out at 765° F. (407° C.), 2250 psig $H_2$ and 4800 SCFB $H_2$, essentially in accordance with the procedure described in Example II.

The following refractory materials were employed:

(1) $SiO_2$ having a surface area (BET, with Hg) of 162 $m^2/g$ and a pore volume (with Hg) of 0.74 cc/g; marketed by Davison Chemical Division of W. R. Grace and Co., Baltimore, Md.

(2) MgO having a surface area (BET, with Hg) of 54 $m^2/g$ and a pore volume (with Hg) of 0.41 cc/g; marketed by Dart Industries (a subsidiary of Dart and Kraft, Los Angeles, Calif.).

(3) $AlPO_4$ having been prepared by reaction of $Al(NO_3).9H_2O$, $H_3PO_4$ and $NH_3$ in aqueous solution at a pH of 7–8, and calcination at 700° F. for 2 hours.

(4) $Zn_2TiO_4$ (zinc titanate) having a surface area (BET, with Hg) of 24.2 $m^2/g$ and a pore volume (with Hg) of 0.36 cc/g; prepared in accordance with the procedure disclosed in U.S. Pat. No. 4,371,728, Example I.

(5) $Zn(AlO_2)_2$ (zinc aluminate) having a surface area of 40 $m^2/g$ and a pore volume of 0.33 cc/g; marketed by Harshaw Chemical Company (a subsidiary of Gulf Oil Co.), Cleveland, Ohio.

Pertinent experimental data are summarized in Table V. These data show that the above-cited supports generally are almost as effective as alumina in removing nickel and vanadium, in the presence of dissolved $Mo(CO)_6$. While base line runs were not made, it is believed that an improvement of at least about 10% was provided by the addition of molybdenum hexacarbonyl in all cases.

The amount of sulfur in the product (not listed in Table V) ranged from about 2.1–2.4 weight-% for all runs. The amount of Ramsbottom carbon in the product ranged from about 9.0–10.8 weight-% for all runs.

TABLE V

| Run | Solid Catalyst | Days on Stream | LHSV (cc/cc/hr) | Feed Added Mo (ppm) | Feed Ni (ppm) | Feed V (ppm) | Feed Ni + V (ppm) | Product Ni (ppm) | Product V (ppm) | Product Ni + V (ppm) | % Removal of (Ni + V) |
|---|---|---|---|---|---|---|---|---|---|---|---|
| 13 (Invention) | $SiO_2$ | 2 | 1.07 | 79 | 81 | 314 | 395 | 59 | 107 | 166 | 58 |
| | | 3 | 0.94 | 79 | 81 | 314 | 395 | 53 | 86 | 139 | 65 |
| | | 4 | 0.90 | 79 | 81 | 314 | 395 | 41 | 85 | 126 | 68 |
| | | 5 | 0.90 | 79 | 81 | 314 | 395 | 51 | 93 | 144 | 64 |
| | | 6 | 0.98 | 79 | 81 | 314 | 395 | 42 | 99 | 141 | 64 |
| | | 7 | 1.02 | 79 | 81 | 314 | 395 | 47 | 123 | 170 | 57 |
| | | 8 | 1.00 | 79 | 81 | 314 | 395 | 39 | 113 | 152 | 62 |
| | | 9 | 1.07 | 79 | 81 | 314 | 395 | 39 | 125 | 164 | 58 |
| | | 10 | 1.07 | 79 | 81 | 314 | 395 | 43 | 124 | 167 | 58 |
| | | 11 | 1.07 | 79 | 81 | 314 | 395 | 40 | 128 | 168 | 58 |
| 14 (Invention) | $AlPO_4$ | 2 | 1.02 | 79 | 81 | 314 | 395 | 83 | 273 | 356 | 10 |
| | | 3 | 0.93 | 79 | 81 | 314 | 395 | 64 | 179 | 243 | 38 |
| | | 4 | 0.93 | 79 | 81 | 314 | 395 | 63 | 177 | 240 | 39 |
| | | 5 | 0.93 | 79 | 81 | 314 | 395 | 59 | 154 | 213 | 46 |
| | | 6 | 0.89 | 79 | 81 | 314 | 395 | 44 | 120 | 164 | 58 |
| | | 7 | 0.97 | 79 | 81 | 314 | 395 | 46 | 142 | 188 | 52 |

TABLE V-continued

| Run | Solid Catalyst | Days on Stream | LHSV (cc/cc/hr) | Feed Added Mo (ppm) | Feed Ni (ppm) | Feed V (ppm) | Feed Ni + V (ppm) | Product Ni (ppm) | Product V (ppm) | Product Ni + V (ppm) | % Removal of (Ni + V) |
|---|---|---|---|---|---|---|---|---|---|---|---|
| | | 8 | 1.01 | 79 | 81 | 314 | 395 | 42 | 143 | 185 | 53 |
| | | 9 | 0.97 | 79 | 81 | 314 | 395 | 41 | 135 | 176 | 55 |
| | | 10 | 0.97 | 79 | 81 | 314 | 395 | 37 | 123 | 160 | 59 |
| | | 11 | 0.97 | 79 | 81 | 314 | 395 | 40 | 132 | 172 | 56 |
| | | 12 | 0.97 | 79 | 81 | 314 | 395 | 42 | 135 | 177 | 55 |
| 15 (Invention) | MgO | 2 | — | 22 | 96 | 380 | 476 | 87 | 292 | 379 | 20 |
| | | 3 | — | 22 | 96 | 380 | 476 | 86 | 286 | 372 | 22 |
| | | 4 | — | 22 | 96 | 380 | 476 | 84 | 259 | 343 | 28 |
| | | 5 | — | 22 | 96 | 380 | 476 | 78 | 227 | 305 | 36 |
| | | 6 | 0.99 | 22 | 96 | 380 | 476 | 101 | 233 | 334 | 29 |
| | | 7 | 1.08 | 22 | 96 | 380 | 476 | 98 | 257 | 355 | 25 |
| | | 9 | 1.05 | 22 | 96 | 380 | 476 | 74 | 199 | 273 | 43 |
| | | 10 | 1.04 | 22 | 96 | 380 | 476 | 82 | 221 | 303 | 36 |
| 16 (Invention) | $Zn(AlO_2)_2$ | 2 | 1.11 | 79 | 81 | 314 | 395 | 57 | 199 | 256 | 37 |
| | | 4 | 1.08 | 79 | 81 | 314 | 395 | 48 | 137 | 185 | 53 |
| | | 5 | 1.02 | 79 | 81 | 314 | 395 | 47 | 123 | 170 | 57 |
| | | 6 | — | 79 | 81 | 314 | 395 | 50 | 145 | 195 | 51 |
| | | 7 | 0.89 | 79 | 81 | 314 | 395 | 40 | 90 | 130 | 67 |
| | | 8 | 0.98 | 79 | 81 | 314 | 395 | 44 | 111 | 155 | 61 |
| | | 9 | 1.06 | 79 | 81 | 314 | 395 | 52 | 124 | 176 | 55 |
| | | 10 | 0.98 | 79 | 81 | 314 | 395 | 48 | 102 | 150 | 62 |
| | | 12 | 0.96 | 79 | 81 | 314 | 395 | 44 | 88 | 132 | 67 |
| | | 14 | 0.96 | 79 | 81 | 314 | 395 | 49 | 110 | 157 | 60 |
| | | 15 | 1.00 | 79 | 81 | 314 | 395 | 49 | 125 | 174 | 56 |
| | | 17 | 0.96 | 79 | 81 | 314 | 395 | 50 | 107 | 157 | 60 |
| 17 (Invention) | $Zn_2TiO_4$ | 2 | 1.03 | 79 | 81 | 314 | 395 | 57 | 140 | 197 | 50 |
| | | 3 | 1.00 | 79 | 81 | 314 | 395 | 63 | 130 | 193 | 51 |
| | | 4 | 1.00 | 79 | 81 | 314 | 395 | 60 | 128 | 188 | 52 |
| | | 5 | 1.00 | 79 | 81 | 314 | 395 | 58 | 121 | 179 | 55 |
| | | 6 | 1.03 | 79 | 81 | 314 | 395 | 47 | 121 | 168 | 58 |
| | | 7 | 0.98 | 79 | 81 | 314 | 395 | 46 | 124 | 170 | 57 |
| | | 8 | 0.95 | 79 | 81 | 314 | 395 | 36 | 114 | 150 | 62 |
| | | 9 | 0.99 | 79 | 81 | 314 | 395 | 36 | 118 | 154 | 61 |
| | | 10 | 1.02 | 79 | 81 | 314 | 395 | 40 | 130 | 170 | 57 |
| | | 11 | 1.02 | 79 | 81 | 314 | 395 | 37 | 129 | 160 | 59 |
| | | 12 | 1.02 | 79 | 81 | 314 | 395 | 37 | 128 | 165 | 58 |

EXAMPLE VI

This example demonstrates the unsuitability of low surface area refractory materials plus $Mo(CO)_6$ (dissolved in a topped Arabian heavy oil feed) as demetallization and desulfurization agents. The heavy oil (containing Mo) was hydrotreated in a fixed bed of two low surface area materials: Alundum $Al_2O_3$ (see Example I) and 1/16"×⅛" stainless steel chips, essentially in accordance with the procedure of Example II. As data in Table VI show, reactor plugging occured after a few days.

TABLE VI

| Run | Solid Catalyst | Days on Stream | LHSV (cc/cc/hr) | Feed Added Mo (ppm) | Feed Ni (ppm) | Feed V (ppm) | Feed Ni + V (ppm) | Feed S (wt %) |
|---|---|---|---|---|---|---|---|---|
| 18 (Control) | Steel | 3 | 1.04 | 0 | 37 | 110 | 147 | ~4 |
| | Chips | 4 | 1.01 | 0 | 37 | 110 | 147 | ~4 |
| | | 5 | 1.01 | 0 | 37 | 110 | 147 | ~4 |
| | | 9 | 1.01 | 0 | 37 | 110 | 147 | ~4 |
| | | 12 | 1.01 | 0 | 37 | 110 | 147 | ~4 |
| | | 16 | 1.00 | 0 | 37 | 110 | 147 | ~4 |
| 19 (Control) | Steel | 1 | 1.05 | 15 | 28 | 99 | 127 | ~4 |
| | Chips | 2 | — | 15 | 28 | 99 | 127 | ~4 |
| | | 3 | — | 15 | 28 | 99 | 127 | ~4 |
| 20 (Control) | Alundum | 1 | ~1 | 15 | 28 | 99 | 127 | ~4 |

| Run | Product Ni (ppm) | Product V (ppm) | Product Ni + V (ppm) | Product S (wt %) | % Removal of (Ni + V) | % Removal of S |
|---|---|---|---|---|---|---|
| 18 (Control) | 37 | 100 | 137 | 4.04 | 7 | 0 |
| | 37 | 113 | 150 | 4.10 | 0 | 0 |
| | 29 | 101 | 130 | — | 12 | — |
| | 36 | 113 | 149 | 4.02 | 0 | 0 |
| | 35 | 102 | 137 | 4.02 | 7 | 0 |
| | 33 | 102 | 135 | 3.92 | 8 | 0 |
| 19 (Control) | 29 | 71 | 100 | 3.45 | 21 | 14 |
| | 27 | 64 | 91 | 3.45 | 28 | 14 |
| | reactor plugged; test was terminated | | | | | |
| 20 (Control) | reactor plugged; test was terminated | | | | | |

EXAMPLE VII

This example describes the hydrotreatment of a desolventized (stripped) extract of a topped (650F+) Hondo Californian heavy crude (extracted with n-pentane under supercritical conditions), in the presence of American Cyanamid Trilobe® alumina (see Example I) and Molyvan® 807, an oil-soluble molybdenum dithiocarbamate lubricant additive and antioxidant, containing about 4.6 weight-% of Mo, marketed by Vanderbilt Company, Los Angeles, CA. In invention run 36, 33.5 lb of the Hondo extract were blended with 7.5 grams of Molyvan and then hydrotreated at 700°-750° F., 2250 psig $H_2$ and 4800 SCFB of $H_2$, essentially in accordance with the procedure of Examples II. Experimental results, which are summarized in Table VII, show the beneficial effect of the dissolved molybdenum dithiocarbamate compound on the degree of hydrometallization of the Hondo extract feed.

TABLE VII

| Run | Days on Stream | LHSV (cc/cc/hr) | Temp. (°F.) | Demetalliz. Agent | Feed: Added Mo (ppm) | Feed: Ni (ppm) | Feed: V (ppm) | Feed: Ni + V (ppm) | Product: Ni (ppm) | Product: V (ppm) | Product: Ni + V (ppm) | % Removal (Ni + V) |
|---|---|---|---|---|---|---|---|---|---|---|---|---|
| 21 | 3 | 1.58 | 750 | None | 0 | 67 | 133 | 200 | 22 | 34 | 56 | 72 |
| (control) | 4 | 1.58 | 750 | None | 0 | 67 | 133 | 200 | 21 | 33 | 54 | 73 |
| | 5 | 1.62 | 750 | None | 0 | 67 | 133 | 200 | 21 | 31 | 52 | 74 |
| | 6 | 1.58 | 750 | None | 0 | 67 | 133 | 200 | 18 | 30 | 48 | 76 |
| 22 | 3 | 1.56 | 748 | Molyvan 807 | 25 | 55 | 123 | 178 | 12 | 17 | 29 | 84 |
| (Invention) | 4 | 1.56 | 743 | Molyvan 807 | 25 | 55 | 123 | 178 | 13 | 11 | 24 | 87 |
| | 5 | 1.56 | 743 | Molyvan 807 | 25 | 55 | 123 | 178 | 9 | 9 | 18 | 90 |
| | 7 | 1.52 | 704 | Molyvan 807 | 25 | 55 | 123 | 178 | 22 | 37 | 59 | 67 |

EXAMPLE VIII

This example illustrate a slurry-type hydrofining process (hydrovisbreaking). About 110 grams of pipeline-grade Monagas heavy oil (containing 392 ppm V and 100 ppm Ni) plus, when desired, variable amounts of decomposable molybdenum compound and a refractory material were added to a 300 cc autoclave (provided by Autoclave Engineers, Inc., Erie, PA). The reactor content was stirred at about 1000 r.p.m., pressured with about 1000 psig hydrogen gas, and heated for about 2.0 hours at about 410° F. The reactor was then cooled and vented, and its content was analyzed. Results of representative runs are summarized in Table VIII. These runs show the beneficial result of adding the dissolved molybdenum to the slurry process.

TABLE VIII

| Run | Dispersed Refractory Material | Dissolved Mo Compound | Temperature (°C.) | ppm (Ni + V) in Product | % Removal of (Ni + V) |
|---|---|---|---|---|---|
| 37 (Control) | 0 | 0 | 420 | 136 | 72 |
| 38 (Control) | 5 wt % $SiO_2$[1] | 0 | 420 | 129 | 74 |
| 39 (Invention) | 5 wt % $SiO_2$ | 1 wt % Mo as $Mo(CO)_6$ | 419 | 95 | 81 |
| 40 (Invention) | 5 wt % $SiO_2$ | 1 wt % Mo as $Mo(CO)_6$ | 410 | 78 | 84 |
| 41 (Invention) | 5 wt % $SiO_2$ | 1 wt % Mo as Molyvan ® 807[2] | 410 | 4 | 99 |
| 42 (Invention) | 5 wt % $SiO_2$ | 0.5 wt % Mo as Molyvan ® 807 | 410 | 3 | 99 |
| 43 (Invention) | 5 wt % $SiO_2$ | 0.1 wt % Mo as Molyvan ® 807 | 410 | 200[4] | 59[4] |
| 44 (Invention) | 5 wt % $SiO_2$ | 1 wt % Mo as Molyvan ® L[3] | 410 | 3 | 99 |
| 45 (Invention) | 5 wt % $SiO_2$ | 0.5 wt % Mo as Molyvan ® L | 410 | 3 | 99 |
| 46 (Invention) | 5 wt % $SiO_2$ | 0.1 wt % Mo as Molyvan ® L | 410 | 123 | 75 |

[1]amorphous Hi-Sil silica, having a surface area of about 140-160 $m^2/g$ and an average particle size of 0.022 microns; marketed by PPG Industries, Pittsburgh, PA;
[2]a mixture of about 50 weight % molybdenum (V) ditridecyldithiocarbamate and about 50 weight % of an aromatic oil (specific gravity: 0.963; viscosity at 210° F.: 38.4 SUS); Molyvan ® 807 contains about 4.6 weight % Mo; it is marketed as an antioxidant and antiwear additive by R. T. Vanderbilt Company, Norwalk, CT;
[3]a mixture of about 80 weight % of a sulfided molybdenum (V) dithiophosphate of the formula $Mo_2S_2O_2[PS_2(OR)_2]$ wherein R is the 2-ethylhexyl group, and about 20 weight % of an aromatic oil (see footnote 2); marketed by R. T. Vanderbilt Company;
[4]results believed to be erroneous.

EXAMPLE IX

Two continuous slurry-type hydrometallization (hydrovisbreaking) runs were carried out with a topped (650° F.+) Hondo heavy crude oil. In Run 47, the crude was pumped at a rate of about 1.7 lb/hr and was mixed with about 0.05 lb/hr (3.0 wt-%) of Hi-Sil silica, about $2.6\times10^{-4}$ lb/hr of Mo (150 ppm Mo) as $Mo(CO)_6$ and about 2881 scf/barrel of $H_2$ gas in a stainless steel pipe of about ¼ inch diameter. The oil/gas mixture was then heated in a coil (60 ft long, ¼ inch diameter) by means of an electric furnace and pumped into a heated reactor (4 inch diameter, 26 inch length) through an induction tube extending close to the reactor bottom. The product exited through an eduction tube, which was positioned so as to provide an average residence time of the oil/gas mixture of about 90 minutes, at the reaction conditions of about 800° F./1000 psig $H_2$. The product passed through a pressure let-down valve into a series of phase separators and coolers. All liquid fractions were combined and analyzed for metals. About 41 weight-% V and about 27 weight-% Ni were removed in Run 47.

In a second test (Run 48) at 780° F. with 100 ppm Mo as $Mo(CO)_6$ and 3.0 weight-% $SiO_2$ in the above-described continuous slurry operation, about 51 weight-% V and about 23 weight-% Ni were removed.

No run without the addition of Mo was made as a control. However, it is believed that the results of such a run would have been significantly poorer than the results of the runs set forth above.

Reasonable variations and modifications are possible within the scope of the disclosure in the appended claims to the invention.

What is claimed is:

1. A process for hydrofining a hydrocarbon-containing feed stream comprising the steps of:

introducing a suitable quantity of a suitable decomposable compound of a metal selected from the group consisting of copper and the metals of Group V-B, Group VI-B, Group VII-B and Group VIII of the Periodic Table into said hydrocarbon-containing feed stream; and contacting said hydrocarbon-containing feed stream containing said decomposable compound under suitable hydrofining conditions with hydrogen and a suitable refractory inorganic material, wherein the concentration of transition metals selected from the group consisting of the metals of copper and Group V-B, Group VI-B, Group VII-B and Group VIII of the Periodic Table in said refractory inorganic material is less than about 1 weight-%, based on the weight of said refractory inorganic material, when said refractory inorganic material is initially contacted with said hydrocarbon-containing feed stream, and wherein said decomposable compound is selected from the group consisting of carbonyls and dithiocarbamates.

2. A process in accordance with claim 1 wherein said decomposable compound is selected from the group consisting of molybdenum hexacarbonyl and molybdenum dithiocarbamate.

3. A process in accordance with claim 1 wherein a sufficient quantity of said decomposable compound is added to said hydrocarbon-containing feed stream to result in a concentration of the metal in said decomposable compound in said hydrocarbon feed stream in the range of about 1 to about 600 ppm.

4. A process in accordance with claim 1 wherein a sufficient quantity of said decomposable compound is added to said hydrocarbon-containing feed stream to result in a concentration of the metal in said decomposable compound in said hydrocarbon feed stream in the range of about 2 to about 100 ppm.

5. A process in accordance with claim 1 wherein said refractory inorganic material has a surface area in the range of about 10 to about 500 $m^2/g$ and a pore volume in the range of about 0.1 to about 3.0 cc/g.

6. A process in accordance with claim 1 wherein said refractory inorganic material has a surface area in the range of about 20 to about 300 $m^2/g$ and a pore volume in the range of about 0.3 to about 1.5 cc/g.

7. A process in accordance with claim 1 wherein said refractory inorganic material is selected from the group consisting of silica, metal oxides, metal silicates, chemically combined metal oxides, metal phosphates and mixtures of any two or more thereof.

8. A process in accordance with claim 7 wherein said refractory inorganic material is selected from the group consisting of alumina, silica, silica-alumina, aluminosilicates, $P_2O_5$-alumina, $B_2O_3$-alumina, magnesium oxide, calcium oxide, lanthanium oxide, cerium oxides, thorium dioxide, titanium dioxide, titania-alumina, zirconium dioxide, aluminum phosphate, magnesium phosphate, calcium phosphate, cerium phosphate, thorium phosphate, zirconium phosphate, zinc phosphate, zinc aluminate and zinc titanate.

9. A process in accordance with claim 8 wherein said refractory metal oxide contains about 95 weight-% alumina based on the weight of said refractory metal oxide.

10. A process in accordance with claim 8 wherein said refractory metal oxide contains about 97 weight-% alumina based on the weight of said refractory metal oxide.

11. A process in accordance with claim 8 wherein said refractory inorganic material is zinc titanate.

12. A process in accordance with claim 8 wherein said refractory inorganic material is zinc aluminate.

13. A process in accordance with claim 1 wherein said suitable hydrofining conditions comprise a reaction time between said refractory inorganic material and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

14. A process in accordance with claim 1 wherein said suitable hydrofining conditions comprise a reaction time between said refractory inorganic material and said hydrocarbon-containing feed stream in the range of about 0.4 hours to about 4 hours, a temperture in the range of 350° C. to about 450° C., a pressure in the range of about 500 to about 3,000 psig and hydrogen flow rate in the range of about 1,000 to about 6,000 standard cubic feet per barrel of said hydrocarbon-containing feed stream.

15. A process in accordance with claim 1 wherein said hydrofining process is a demetallization process and wherein said hydrocarbon-containing feed stream contains metals.

16. A process in accordance with claim 15 wherein said metals are nickel and vanadium.

17. A process in accordance with claim 1 wherein said hydrofining process is a desulfurization process and wherein said hydrocarbon-containing feed stream contains organic sulfur compounds.

18. A process in accordance with claim 19 wherein said organic sulfur compounds are selected from the group consisting of sulfides, disulfides, mercaptans, thiophenes, benzylthiophenes, and dibenzylthiophenes.

19. A process in accordance with claim 1 wherein said hydrofining process is a process for removing Ramsbottom carbon residue and wherein said hydrocarbon-containing feed stream contains Ramsbottom carbon residue.

20. A process in accordance with claim 2 wherein said decomposable compound is molybdenum hexacarbonyl.

21. A process in accordance with claim 2 wherein said decomposable compound is molybdenum dithiocarbamate.

22. A process for hydrofining a hydrocarbon-containing feed stream comprising the steps of:

introducing a suitable quantity of a suitable decomposable compound of a metal selected from the group consisting of copper, zinc and the metals of Group III-B, Group IV-B, Group V-B, Group VI-B, Group VII-B and Group VIII of the Periodic Table into said hydrocarbon-containing feed stream; and contacting said hydrocarbon-containing feed stream containing said decomposable compound under suitable hydrofining conditions with hydrogen and a suitable refractory inorganic material, wherein the concentration of transition metals selected from the group consisting of the metals of copper, zinc and Group III-B, Group IV-B, Group V-B, Group VI-B, Group VII-B and Group VIII of the Periodic Table in said refractory inorganic material is less than about 1 weight-%, based on the weight of said refractory inorganic material, when said refractory inorganic material is initially contacted with said hydrocarbon-containing feed stream, and wherein said suitable decomposable compound is selected from the group consisting of carbonyls, dithiocarbamates and dithiophosphates.

23. A process in accordance with claim 22 wherein said decomposable compound is selected from the group consisting of molybdenum hexacarbonyl, molybdenum dithiocarbamate and molybdenum dithiophosphate.

24. A process in accordance with claim 22 wherein a sufficient quantity of said decomposable compound is added to said hydrocarbon-containing feed stream to result in a concentration of the metal in said decomposable compound in said hydrocarbon feed stream in the range of about 1 to about 600 ppm.

25. A process in accordance with claim 22 wherein a sufficient quantity of said decomposable compound is added to said hydrocarbon-containing feed stream to result in a concentration of the metal in said decomposable compound in said hydrocarbon feed stream in the range of about 2 to about 100 ppm.

26. A process in accordance with claim 22 wherein said refractory inorganic material has a surface area in the range of about 10 to about 500 $m^2/g$ and a pore volume in the range of about 0.1 to about 3.0 cc/g.

27. A process in accordance with claim 22 wherein said refractory inorganic material has a surface area in the range of about 20 to about 300 $m^2/g$ and a pore volume in the range of about 0.3 to about 1.5 cc/g.

28. A process in accordance with claim 22 wherein said refractory inorganic material is selected from the group consisting of silica, metal oxides, metal silicates, chemically combined metal oxides, metal phosphates and mixtures of any two or more thereof.

29. A process in accordance with claim 28 wherein said refractory inorganic material is selected from the group consisting of alumina, silica, silica-alumina, aluminosilicates, $P_2O_5$-alumina, $B_2O_3$-alumina, magnesium oxide, calcium oxide, lanthanium oxide, cerium oxides, thorium dioxide, titanium dioxide, titania-alumina, zirconium dioxide, aluminum phosphate, magnesium phosphate, calcium phosphate, cerium phosphate, thorium phosphate, zirconium phosphate, zinc phosphate, zinc aluminate and zinc titanate.

30. A process in accordance with claim 29 wherein said refractory metal oxide contains about 95 weight-% alumina based on the weight of said refractory metal oxide.

31. A process in accordance with claim 29 wherein said refractory metal oxide contains about 97 weight-% alumina based on the weight of said refractory metal oxide.

32. A process in accordance with claim 29 wherein said refractory inorganic material is zinc titanate.

33. A process in accordance with claim 29 wherein said refractory inorganic material is zinc aluminate.

34. A process in accordance with claim 22 wherein said suitable hydrofining conditions comprise a reaction time between said refractory inorganic material and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

35. A process in accordance with claim 22 wherein said suitable hydrofining conditions comprise a reaction time between said refractory inorganic material and said hydrocarbon-containing feed stream in the range of about 0.4 hours to about 4 hours, a temperature in the range of 350° C. to about 450° C., a pressure in the range of about 500 to about 3,000 psig and hydrogen flow rate in the range of about 1,000 to about 6,000 standard cubic feet per barrel of said hydrocarbon-containing feed stream.

36. A process in accordance with claim 22 wherein said hydrofining process is a demetallization process and wherein said hydrocarbon-containing feed stream contains metals.

37. A process in accordance with claim 36 wherein said metals are nickel and vanadium.

38. A process in accordance with claim 22 wherein said hydrofining process is a desulfurization process and wherein said hydrocarbon-containing feed stream contains organic sulfur compounds.

39. A process in accordance with claim 38 wherein said organic sulfur compounds are selected from the group consisting of sulfides, disulfides, mercaptans, thiophenes, benzylthiophenes, and dibenzylthiophenes.

40. A process in accordance with claim 22 wherein said hydrofining process is a process for removing Ramsbottom carbon residue and wherein said hydrocarbon-containing feed stream contains Ramsbottom carbon residue.

41. A process in accordance with claim 23 wherein said decomposable compound is molybdenum dithiophosphate.

42. A process for hydrofining a hydrocarbon-containing feed stream comprising the steps of:

introducing a suitable quantity of a suitable decomposable compound of a metal selected from the group consisting of copper, zinc and the metals of Group III-B, Group IV-B, Group V-B, Group VI-B, Group VII-B and Group VIII of the Periodic Table and a suitable refractory inorganic material into said hydrocarbon-containing feed stream to form a slurry; and contacting said slurry under suitable hydrofining conditions with hydrogen in a reactor, wherein the concentration of transition metals selected from the group consisting of the metals of copper, zinc and Group III-B, Group IV-B, Group V-B, Group VI-B, Group VII-B and Group VIII of the Periodic Table in said refractory inorganic material is less than about 1 weight-%, based on the weight of said refractory inorganic material, when said refractory inorganic material is initially introduced into said hydrocarbon-containing feed stream, and wherein said suitable decomposable compound is selected from the group consisting of carbonyls, dithiocarbamates and dithiophosphates.

43. A process in accordance with claim 42 wherein said decomposable compound is selected from the group consisting of molybdenum hexacarbonyl, molybdenum dithiocarbamate and molybdenum dithiophosphate.

44. A process in accordance with claim 42 wherein a sufficient quantity of said decomposable compound is added to said hydrocarbon-containing feed stream to result in a concentration of the metal in said decomposable compound in said slurry in the range of about 1 to about 600 ppm.

45. A process in accordance with claim 42 wherein a sufficient quantity of said decomposable compound is added to said hydrocarbon-containing feed stream to result in a concentration of the metal in said decomposable compound in said slurry in the range of about 2 to about 100 ppm.

46. A process in accordance with claim 42 wherein said refractory inorganic material has a surface area in the range of about 10 to about 500 $m^2/g$ and a pore volume in the range of about 0.1 to about 3.0 cc/g.

47. A process in accordance with claim 42 wherein said refractory inorganic material has a surface area in the range of about 20 to about 300 $m^2/g$ and a pore volume in the range of about 0.3 to about 1.5 cc/g.

48. A process in accordance with claim 48 wherein said refractory inorganic material is selected from the group consisting of silica, metal oxides, metal silicates, chemically combined metal oxides, metal phosphates and mixtures of any two or more thereof.

49. A process in accordance with claim 48 wherein said refractory inorganic material is selected from the group consisting of alumina, silica, silica-alumina, aluminosilicates, $P_2O_5$-alumina, $B_2O_3$-alumina, magnesium oxide, calcium oxide, lanthanium oxide, cerium oxides, thorium dioxide, titanium dioxide, titania-alumina, zirconium dioxide, aluminum phosphate, magnesium phosphate, calcium phosphate, cerium phosphate, thorium phosphate, zirconium phosphate, zinc phosphate, zinc aluminate and zinc titanate.

50. A process in accordance with claim 49 wherein said refractory metal oxide is silica.

51. A process in accordance with claim 42 wherein said suitable hydrofining conditions comprise a reaction time in said reactor for said slurry in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said slurry.

52. A process in accordance with claim 51 wherein said suitable hydrofining conditions comprise a reaction time is said reactor for said slurry in the range of about 0.4 hours to about 4 hours, a temperture in the range of 350° C. to about 450° C., a pressure in the range of about 500 to about 3,000 psig and hydrogen flow rate in the range of about 1,000 to about 6,000 standard cubic feet per barrel of said slurry.

53. A process in accordance with claim 42 wherein said hydrofining process is a demetallization process and wherein said hydrocarbon-containing feed stream contains metals.

54. A process in accordance with claim 53 wherein said metals are nickel and vanadium.

55. A process in accordance with claim 42 wherein said hydrofining process is a desulfurization process and wherein said hydrocarbon-containing feed stream contains organic sulfur compounds.

56. A process in accordance with claim 55 wherein said organic sulfur compounds are selected from the group consisting of sulfides, disulfides, mercaptans, thiophenes, benzylthiophenes, and dibenzylthiophenes.

57. A process in accordance with claim 42 wherein said hydrofining process is a process for removing Ramsbottom carbon residue and wherein said hydrocarbon-containing feed stream contains Ramsbottom carbon residue.

58. A process in accordance with claim 43 wherein said decomposable compound is molybdenum hexacarbonyl.

59. A process in accordance with claim 43 wherein said decomposable compound is molybdenum dithiocarbamate.

60. A process in accordance with claim 43 wherein said decomposable compound is molybdenum dithiophosphate.

* * * * *